US005773094A

United States Patent [19]

Krückel

[11] Patent Number: 5,773,094

[45] Date of Patent: Jun. 30, 1998

[54] CURTAIN COATING METHOD AND DEVICE FOR PAINTING BODY PARTS OF MOTOR VEHICLES

[75] Inventor: Hubert Krückel, Geilenkirchen, Germany

[73] Assignee: KSK Industrielackierungen GmbH, Geilenkirchen, Germany

[21] Appl. No.: 693,129

[22] PCT Filed: Feb. 1, 1995

[86] PCT No.: PCT/EP95/00351

§ 371 Date: Aug. 13, 1996

§ 102(e) Date: Aug. 13, 1996

[87] PCT Pub. No.: WO95/22410

PCT Pub. Date: Aug. 24, 1995

[30] Foreign Application Priority Data

Feb. 17, 1994 [DE] Germany ..... 44 04 877.7

[51] Int. Cl.[6] ..... B05D 1/30

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS

| | | | |
|---|---|---|---|
| 3,984,902 | 10/1976 | Prazak, III | 427/420 |
| 4,473,027 | 9/1984 | Arfert et al. | 118/304 |
| 4,600,601 | 7/1986 | Tamura | 427/96 |
| 4,838,199 | 6/1989 | Weber | 118/500 |
| 5,096,750 | 3/1992 | Edlert et al. | 427/420 |

FOREIGN PATENT DOCUMENTS

| | | | |
|---|---|---|---|
| 0 145 648 | 6/1985 | European Pat. Off. . | |
| 0 222 563 | 5/1987 | European Pat. Off. . | |
| 4-190875 | 7/1992 | Japan | 427/420 |

OTHER PUBLICATIONS

Curtain Coating Picture Frames, pamphlet, by Darrell Ward, Mar. 1959.

*Primary Examiner*—Katherine A. Bareford
*Attorney, Agent, or Firm*—Browdy and Neimark

[57] ABSTRACT

A paint curtain device is proposed in which object (13) to be painted are moved through a paint curtain (5) consisting of liquid paint. In order to make possible the optimal orientation of the objects (13) to be painted, while passing through the paint curtain (5) they are continuously fixed in place on holding means (25) of a conveying system (12) which crosses through the paint curtain (5) when passing through the area of a lateral edge (16). Furthermore, a method for painting objects (13) is proposed for whose execution the paint curtain device is suited.

15 Claims, 2 Drawing Sheets

CURTAIN COATING METHOD AND DEVICE FOR PAINTING BODY PARTS OF MOTOR VEHICLES

BACKGROUND OF THE INVENTION

This invention is a national stage application of PCT/EP95/00351, filed Feb. 1, 1995.

TECHNICAL FIELD OF THE INVENTION

The invention relates to a method for painting visible exterior body parts of motor vehicles in series prior to assembly on the vehicle, wherein a surface of an object to be painted is curved in one dimensional direction.

PRIOR ART

Most of the body parts of passenger cars which remain visible after assembly are painted for the purposes of corrosion protection and for visual reasons prior to being first assembled. An example of such a visible exterior body part is the cover attached to the B pillar, which can be found in several vehicle types and is made of metal and requires the highest possible quality of paint. As a rule the cover is at least slightly curved in the dimensional direction extending in the longitudinal direction in accordance with the future shape of the body.

Up to now, so-called paint spraying has proven itself as a dependable painting system for such objects. Satisfactory painting results have been obtained in spite of the existing curvature of the surface of the object to be painted. However, the costs connected so far with such a painting method are still relatively high. A large part of the sprayed paint does not hit the surface of the object to be painted and is lost through the exhaust air. A recovery for reuse at reasonable costs has not been possible up to now. In addition, expensive protective and filter installations are required to prevent air, which is enriched with solvents to an impermissible degree, from reaching the atmosphere.

OBJECT AND SUMMARY OF THE INVENTION

It is therefore the object of the instant invention to propose a method of the type mentioned at the outset which allows the more cost-effective painting of the objects without loss in quality.

To attain this object it is provided that the objects to be painted are attached to holding means of a conveying system and subsequently moved, still continuously remaining on the respectively assigned holding means, through a falling paint curtain consisting of liquid paint transverse to the plane of falling paint curtain, that the curved surface of the object faces up and the dimensional direction of the curve, viewed from above, coincides with the conveying direction, wherein the orientation of the objects to be painted while they pass through the paint curtain is suitably affected by controlled positioning of the holding means.

Thus, use is made of steps, known per se, of the so-called paint curtain method which up to now had been preponderantly used in the furniture industry. However, it is provided to fix the object to be painted in place on holding devices of a conveying system and to move them through the paint curtain while they continue to be kept on the holding means. In this way the objects to be painted are optimally held during the entire paint application and can even be oriented, if required, by suitable position changes of the holding means in such a way that the coat of paint is optimal in respect to the paint distribution and coating thickness. It has been shown that it is possible in this way to create high-quality paint coatings which give a glass-like impression and satisfy the highest requirements visually as well as in respect to corrosion protection. Since paint spraying does not take place, it is possible to collect the surplus paint from the paint curtain without problems and to reuse it without a large outlay. Since in addition there is hardly any contamination of the air, the outlay for protective or filtering steps is small, so that the method as a whole has been shown to be extremely cost- effective.

Paint curtain devices are known per se. A type known to Applicant has a pouring head for creating a paint curtain consisting of downward flowing liquid paint, a collecting device for unused paint from the paint curtain disposed at a distance below the pouring head and a conveying system disposed outside the area covered by the falling paint curtain for conveying the objects to be painted over a conveying path which crosses the paint curtain transversely in respect to the curtain plane.

The faults of this known device mainly are that objects, whose surface to be painted is uneven and in particular curved, are hard to paint and the quality of the resulting painting does not meet the requirements, particularly those of automobile manufacture. This is particularly true for objects of small size. This is mainly the result of the fact that the object to be painted cannot be exactly guided when passing through the paint curtain, because they must cross a space located between two conveyor belts forming the conveying system and permitting the passage of the paint curtain toward the collecting device.

Thus, a further object of the invention lies in creating a paint curtain device of the above mentioned type which permits time-saving, cost-effective and high-quality painting even of curved object surfaces and of objects of small size.

To attain this object it is provided that holding means are provided on the conveying system which allow the releasable individual fastening of the objects to be painted and on which the objects to be painted remain during the passage through the paint curtain, and that the holding means are oriented from the side towards the conveying path which crosses the curtain plane, so that they pass through the paint curtain in the area of at least one lateral edge.

In this way there is no transfer of objects between parts of the conveying system during the passage through the paint curtain, instead the objects to be painted remain fastened to one and the same holding means. Because of this it is possible to provide the alignment of the objects required for optimal painting results even in case of difficult shapes of the surfaces of the object to be painted. Since the conveying system is still located outside of the area covered by the falling paint curtain, it is protected against soiling by the paint. Only the holding means pass through the paint curtain which, however is of no further disadvantage, since they are respectively only briefly under the falling paint and furthermore can be cleaned without problems. In this way it is possible to operate with a continuously falling paint curtain which is therefore always optimally formed. Since the object to be painted can also be continuously conveyed through, the paint curtain device is very well suited for the series painting of a multitude of the same objects, even of small dimensions, such as occur mainly in the automobile industry.

Advantageous further embodiments of the method in accordance with the invention and of the device in accordance with the invention are further recited below.

BRIEF DESCRIPTION OF THE DRAWINGS

An explanation of the invention follows, making use of the exemplary embodiments of the paint curtain device in accordance with the invention represented in the drawings.

Particularly shown is in.

DETAILED DESCRIPTION OF THE PREFERRED EMBODIMENT(S) OF THE INVENTION

Figure 1:
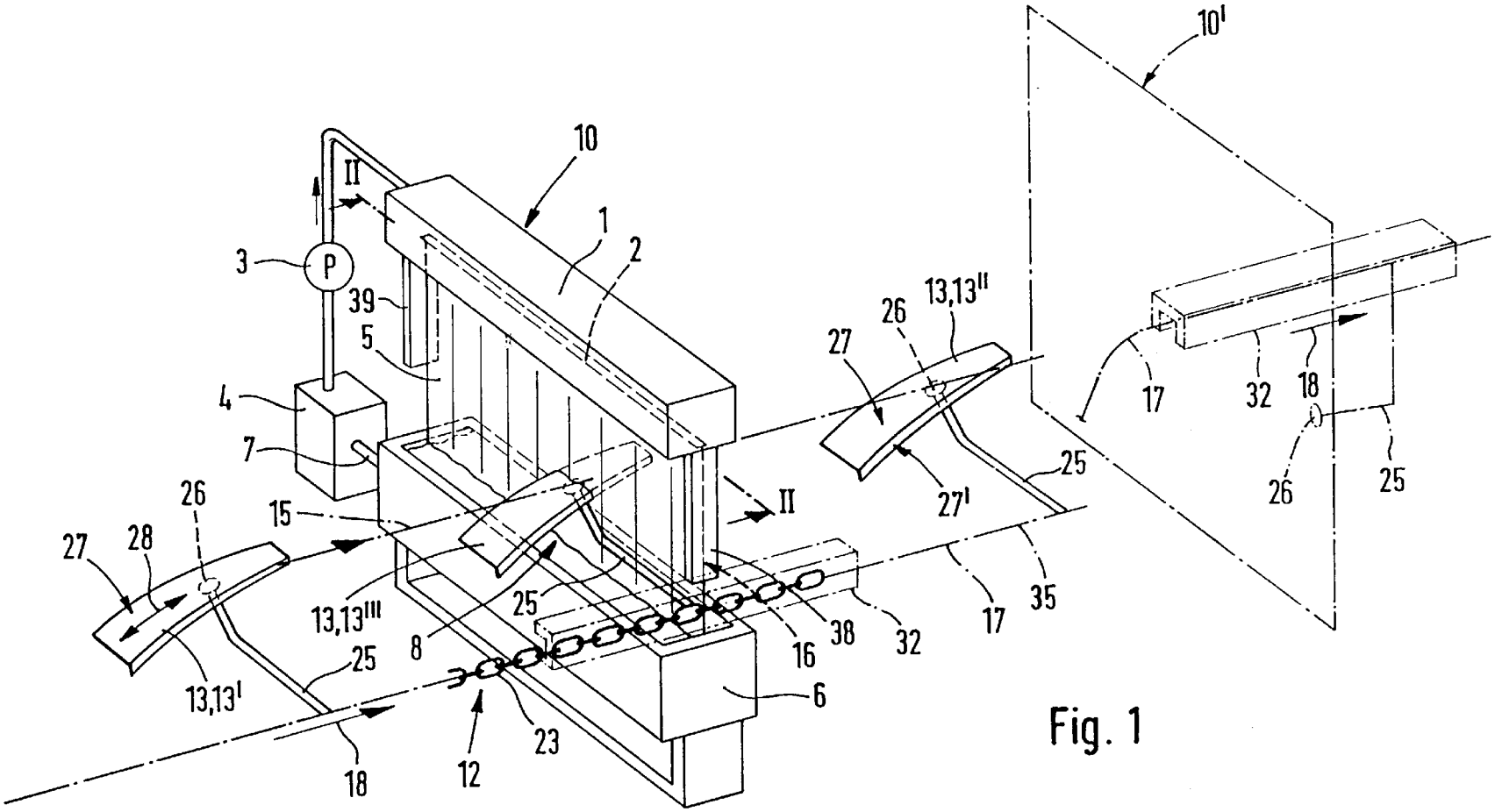
FIG. 1, a preferred structural form of the paint curtain device in accordance with the invention in a largely schematic representation, FIG. 2, a cross section through the paint curtain device in accordance with FIG. 1 in the sectional plane located ahead of the pouring zone indicated by the section line II—II, FIG. 3, a variant embodiment of the holding means used for fixing the object to be painted in place, and FIG. 4, a schematic representation of a preferred mode of operation of the paint curtain device.
Figure 2:
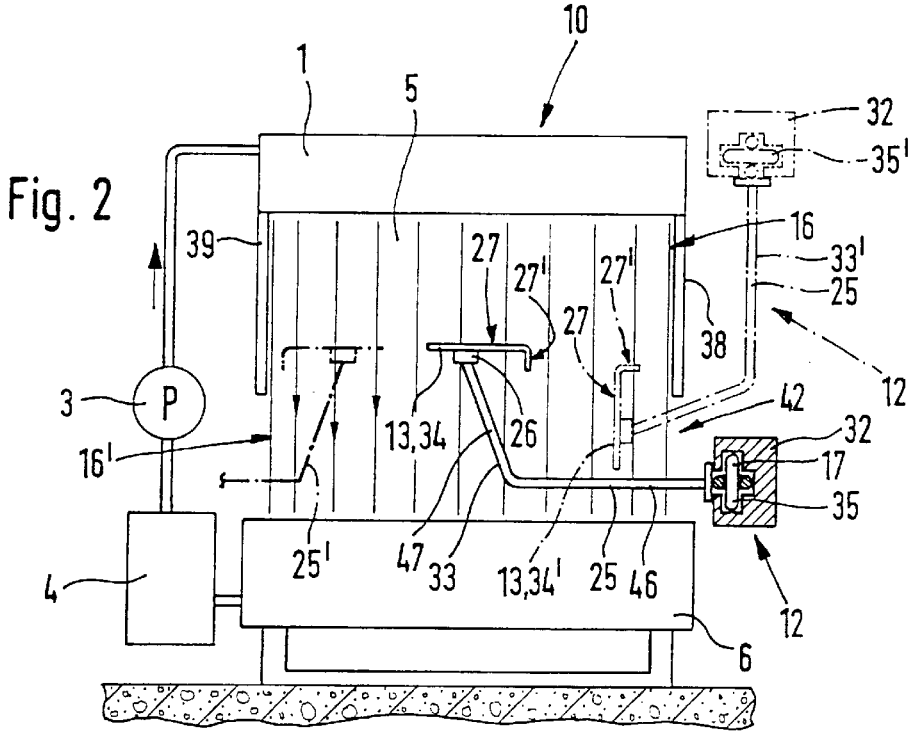

The paint curtain device which can be seen in FIGS. 1 and 2 has a first paint pouring station 10 with a pouring head 1 of a known type, which has an elongated shape and has a longitudinal slit 2 on its underside, indicated by dashed lines. Liquid paint from a reservoir 4 can be supplied to the pouring head 1 by means of a pump 3. Here the term "paint" is understood to be any arbitrary painting or coating material.

In the course of operating the paint curtain device, liquid paint exits downwardly from the pouring head 1 through the longitudinal slit 2 and forms a kind of a cohesive film which in this case is identified as a paint curtain 5. This continuously falling paint curtain 5 falls into a bowl-like collecting device 6 which is disposed at a distance below the pouring head 1 and is vertically located opposite the longitudinal slit 2. A return 7 connected with the collecting device 6 moves the collected paint back into the reservoir 4, from where it is again supplied to the pouring head 1. A processing device, not shown, which assures an even paint quality, can be interposed in the line connection between the collecting device 6 and the pouring head 1.

Figure 4:
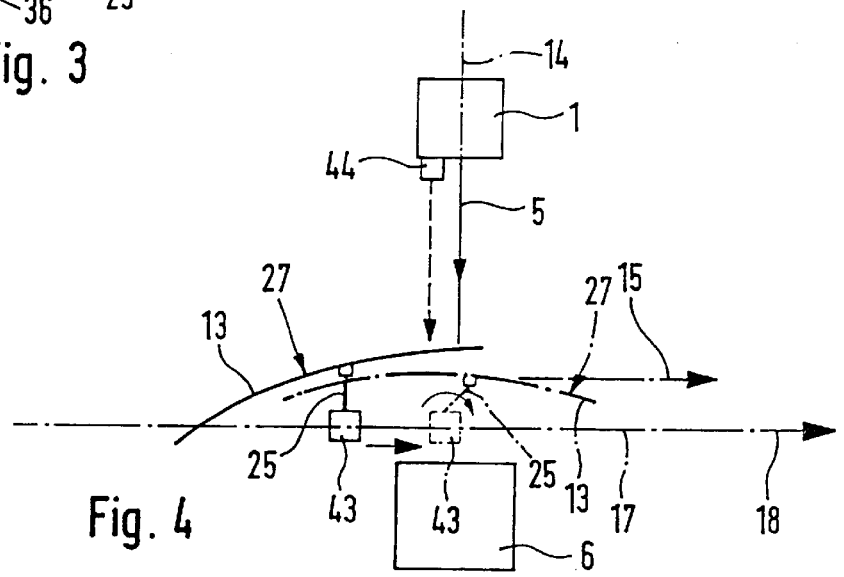

The area occupied by the falling paint curtain 5 during operation is identified as the pouring zone 8. A conveying system 12 is provided outside of this pouring zone 8 and is used to move objects 13 to be painted of any kind through the paint curtain 5 transversely and in particular at right angles to the curtain plane 14 containing the paint curtain 5 (FIG. 4). The conveying path 15 along which the objects 13 move is indicated by dash- dotted lines in FIGS. 1 and 4. It preferably crosses the curtain plane 14 at right angles.

The conveying system 12 in accordance with the example is located laterally next to the pouring zone 8 and extends along it. It adjoins one of the lateral edges 16 of the falling paint curtain 5 (also see FIG. 2).

The conveying system 12 preferably contains a conveyor belt 17, which is only schematically and partially represented. It can be embodied to be endless and closed upon itself. For a conveying movement it can be driven in a movement direction indicated by the arrow 18 by means of a drive motor, not further shown. In connection with the exemplary embodiment, the conveying movement is a circulating movement. The conveyor belt 17 in accordance with the example is a link belt 23 formed by a chain which is guided, for example, by at least two spaced-apart wheels, not shown.

Several holding means 25 are disposed in the movement direction 18 at a distance from each other on the conveyor belt 17. They extend transversely in respect to the movement direction 18 and also transversely in respect to the conveying path 15 which crosses the paint curtain 5. As can be clearly seen from FIG. 2, they project away from the conveyor belt 17 in the transverse direction in the form of booms. They are therefore oriented from the side toward the conveying path 15, in whose area they are respectively equipped with at least one fastening means 26 which allows the releasable fastening of one of the objects 13 to be painted. The embodiment of these fastening means 26 is provided as required, wherein they are permanently magnetic elements in this case which make possible the optimal fixation of the objects 13 which, for example, are made of a ferromagnetic metal. Releasable adhesive means, hook elements, clamping elements or suction elements could be cited as examples of further embodiments. The latter in particular in connection with objects which are made of aluminum or other nonferromagnetic materials.

It is provided th at on the conveying path 15 the objects 13 to be painted remain continuously fastened on the assigned holding means 25 during the passage through the paint curtain 5. Prior to passage through the paint curtain 5 they are fastened on a holding means 25 and are subsequently conveyed by it in the direction toward the paint curtain 5 and through it. In FIG. 1, one of the objects 13' is located in front of the paint curtain 5, a further one (13") has already passed through the paint curtain 5 and another (13'") has just passed approximately halfway through the paint curtain 5. The additional holding means 25 are not represented in FIG. 1 for reasons of clarity.

The uninterrupted fastening with out transfer of the objects 13 during the passage through the paint curtain 5 has the advantage that it is possible without problems to orient the objects 13 in a way which assures the problem-free painting of the surface 27 of the object to be painted. This advantage becomes particularly noticeable in connection with those objects whose surface 27 of the object to be painted is not flat, the same as in the exemplary embodiment, but is curved in a plane parallel to the conveying direction (15) of conveying system (12) —indicated by the two-headed arrow 28—. When penetrating the paint curtain 5, a respective object 13 should be aligned in such a way that the section of the curved surface 27 of the object to be painted facing in the feed direction is higher than the following surface sections which are lowered in a direction opposite the conveying direction. The respectively optimal position is determined empirically, and subsequently the holding means 25 and/or the fastening means 26 are arranged or positioned in such a way that the objects 13 take up the desired basic position of the object. In this case it is advantageous for the holding means 25 and/or the fastening means 26 to be adjustable in respect to the conveyor belt 17.

Since the conveying system 12 is located outside the pouring zone 8, it is not or only slightly soiled by the downward flowing paint. This assures trouble-free operation over extended periods. Only the holding means 25 come briefly into the pouring zone 8 in the course of passing through the paint curtain 5. They cross the paint curtain 5 in the area of the mentioned lateral edge 16. However, since it is possible without problems to embody the holding means 25 relatively narrow, the loss of paint and the soiling remain within narrow limits. Further than that, cleaning which is performed when required is possible without problems because of the small surfaces. For this reason the holding means 25 provided in accordance with the example are embodied as holding arms having a rod structure.

In the exemplary embodiment holding means 25 are only disposed on one side of the pouring zone 8. If necessary, however, it is possible to also dispose holding means 25 (indicated in FIG. 2 at 25') on the opposite side, which are then suitably disposed on a further conveyor belt. In the course of their conveyance in the opposite direction, these oppositely disposed holding means pass through the associated other lateral edge 16' of the paint curtain 5 in a corresponding manner. In this way it is possible to better utilize the width of the paint curtain 5 by simultaneously moving two parallel disposed rows of objects through the paint curtain 5, in which drive means which are independent of each other are possible. There is the further option to hold a respective object simultaneously from two sides, if this appears to be necessary for the stable fixation of objects 13.

The objects 13 which are subjected to the paint process in the exemplary embodiment are sheet metal parts of small size which are used as exterior body parts of automobiles. In the particular case these are metal covers which are installed on the B pillar between the front and rear lateral windows of the automobiles. The surface 27 of the object constituting the visible surface is slightly curved in the longitudinal direction and can therefore extend in particular straight in respect to it or also have a slight curvature. After the objects 13 have previously been degreased, phosphatized and perhaps been provided with a primer, the latter in particular by means of electrostatic paint application, it is possible to first apply a base coat and subsequently a clear coat of paint without problems by means of the paint curtain device in accordance with the invention. If required, it would also be possible to apply only the clear coat. This is a colorless paint which can be UV-hardenable. It has been shown that, following painting, the respective parts have a high-quality glass-like surface which shows no signs of the "orange skin" which is characteristic in spraying methods.

The objects 13 are preferably fixed in place on the holding means 25 in such a way that the surface 27 of the object to be painted points upward, i.e. has an upwardly pointing direction component, wherein furthermore the orientation is provided such that the dimensional direction 28 of the curvature—viewed in a top view vertically from above—coincides with the conveying direction of the objects 13 along the conveying path 15. It is of course also possible to paint the surfaces of flat objects.

The objects 13 to be painted in the exemplary embodiment have, besides the already mentioned first object surface 27, a second surface 27' of the object to be painted, which extends at an angle to the first-mentioned one. The present objects 13 are thin metal parts which are beveled along a longitudinal edge, so that two first and second object surfaces 27, 27' result, which are essentially at right angles to each other. The curtain painting device in accordance with the example is provided with first control means 32, by means of which the holding means 25 can be displaced between two holding positions 33, 33', which can be seen in FIG. 2, in which the objects 13 disposed on it take up two different basic object positions 34, 34', in which respectively one of the object surfaces 27, 27' has the orientation which is optimal for the application of poured paint and which was described above.

The paint curtain device in accordance with the example has a second paint pouring station 10', whose structure corresponds to that of the first (10), so that it is only indicated by dash-dotted lines in FIG. 1. It is disposed downstream at a distance from the first paint pouring station 10 in the conveying direction of the objects 13. In accordance with the example it has been provided that a respective object 13 successively passes through the paint curtain 5 of both paint pouring stations 10, 10', namely the first paint pouring station 10 in the one basic object position 34 and the subsequent second paint pouring station 10' in the other basic object position 34'. FIG. 2 shows the first basic object position 34 in the first paint pouring station 10, wherein the second basic object position 34', taken up in the second paint pouring station 10', and the associated second holding position 33' are shown in dash-dotted lines in order to clarify the different orientations.

In the exemplary embodiment in accordance with FIGS. 1 and 2, in which the holding means 25 are rigidly disposed on the conveyor belt 17, the first control means 32 act on the conveyor belt 17. The zones on which they act are preferably located in the area next to the pouring zone 8 of the respective paint pouring station 10, 10'. As indicated, the first control means 32 can be constituted by rail-like guide means, in which the conveyor belt 17 runs and which have different orientations in the two paint pouring stations 10, 10', so that the conveyor belt 17 and therefore also the holding means 25 fixed on it are forced into different positions during passage. In the exemplary embodiment the profiled guide means, which have an approximate U-like profile in cross section, are pivoted or turned by 90° in respect to the movement direction 18 in order to provide the two holding positions 33, 33'. To make possible the different orientations of the holding means 25 during the successive paint pouring processes, it is recommended to provide different passing heights of the conveyor belt 17 in respect to the paint curtain 5 in the individual paint pouring stations 10, 10', as can be seen from FIGS. 1 and 2. In connection with the exemplary embodiment this is made possible by means of a conveyor belt 17 which extends at different heights in the areas of the paint pouring stations 10, 10', or—with an unchanged horizontal course of the conveyor belt 17—by positioning the associated pouring zones 8 at different heights.

It is advantageous in this connection if the holding means 25 have an angled shape, as illustrated. By means of this it is assured that in each one of the two holding positions 33, 33' a respective object 13 takes up a position in which it penetrates the paint curtain 5 when being displaced along the associated conveying path 15. In accordance with the example, each holding means has a first section 46 connected to the conveyor belt 17 and an end section 47 at an angle therewith, on which the fastening means 26 is located. In the first basic object position 34, during the passage through the paint curtain 5, the first section 46 of the holding means 25 projects transversely in respect to the conveying path 15 and particularly horizontally into the paint curtain 5 and the end section 47 extends upward. In the second basic object position 34' the first section 46 projects particularly vertically downward and only the end section 47 dips into the paint curtain 5 over the space 42.

Figure 3:
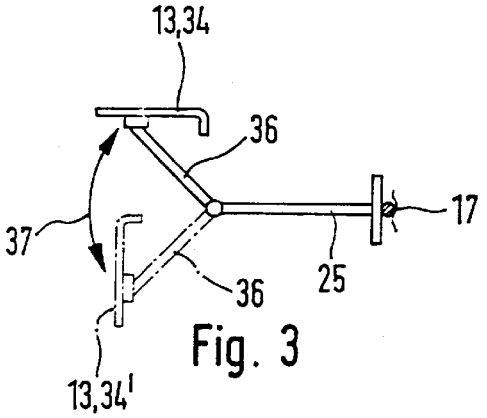

Thus, while in connection with the exemplary embodiment in accordance with FIGS. 1 and 2 the first control means 32 act on the portion (conveyor belt 17) of the conveying system 12 supporting the holding means 25, FIG. 3 shows a variation wherein the first control means, not shown here, act on a movable section 36 of the arm-like holding means 25 without affecting the position of the conveyor belt 17. In this case the movable section 36 suitably is a pivot section, which can be pivoted up and down by the first control means 32 in accordance with the two-headed arrow 37 between the two possible positions. Here the first control means can be constituted by a control cam or control line along which the movable sections 36 of the holding means 25 pass. Otherwise it would also be possible that, instead of a movable section, the entire holding means are movably suspended on the conveyor belt 17.

It would of course also be conceivable to embody the paint curtain device in such a way that a single paint curtain would be passed by the object to be painted several times in different directions.

In order to assure the optimal design of the film-like paint curtain 5, the paint curtain device in accordance with the example has an edge limiter 38, 39 defining the associated lateral edge 16, 16' of the paint curtain 5 on both sides of the pouring zone 8. Starting at the pouring head 1, it extends vertically downward wherein, however, at least the edge limiter 38 assigned to the mentioned lateral edge 16 terminates at a distance above the collecting device 6. In this way a passage 42 remains for the holding means 25 holding the objects 13. The former extend underneath the associated edge limiter 38 when moving through the paint curtain 5 by passing through the passage 42. In this case the objects 13 are fastened on the respective holding means 25 in such a way, that the respective surface 27, 27' of the object to be painted is extended into the area of the paint curtain 5 which is flanked on both sides by the edge limiters 38, 39. In this way the application of the paint takes place in the area of the optimal formation of the paint curtain 5.

A further option for equipping the paint curtain device can be seen in FIG. 4. In this case second control means 43 are provided which permit a position change of the holding means 25 while the respectively associated object 13 passes through the paint curtain 5. In this way it is possible to accommodate special contours of the surface 27 of the objects to be painted and to correct their orientation continuously in respect to a predetermined optimal value during their passage through the paint curtain 5. For this purpose the second control means 43 could have suitable servo motors, for example, for whose control sensors 44 are provided which detect the actual position of the respective object 13 being painted. By way of example it is indicated in FIG. 4 how an arriving object 13, drawn in solid lines, is first aligned in such a way that the front area of the curved surface 27 of the object to be painted pointing in the feed direction extends at right angles in respect to the curtain plane 14. In the course of further penetrating the paint curtain 5, the front surface area is lowered by means of pivoting of the holding means 25 (dash-dotted representation), so that the successive areas of the surface 27 of the object, which are respectively under the influence of the paint curtain 5, always have a right-angled orientation in respect to the curtain plane 14.

I claim:

1. A method for painting body parts of motor vehicles in series prior to assembly of the body parts in the motor vehicles, wherein at least one surface of each part of the body parts to be painted is curved in a plane parallel to a conveying direction of a conveying system for the body parts, the method comprising the steps of:

respectively attaching each said part of the body parts (13) to be painted to a corresponding holding means (25) on the conveying system (12), the conveying system being spaced apart from a falling paint curtain consisting of a liquid paint, the curved surface facing toward the falling paint curtain when moving in the conveying direction of the conveying system (12), the conveying system moving each said body part and the corresponding holding means transversely through a plane of the falling paint curtain to paint each said body part, wherein while passing through the paint curtain (5), each said part (13) to be painted extends into the falling paint curtain (5) from an area located outside of the falling paint curtain (5) on the corresponding holding means (25) which extends from the conveying system past at least one of two lateral edges (16) of the falling paint curtain (5) and wherein a position of the curved surface of each said part (13) being painted is changed by adjusting the corresponding holding means (25).

2. The method in accordance with claim 1, wherein for successive painting of two curved surfaces (27, 27') of each said part (13), the part (13) to be painted is releasably fixed on the corresponding holding means (25) to different paint positions (34, 34') of the part (13) by changing a position of at least one section (36) of the corresponding holding means (25).

3. The method in accordance with claim 1, wherein for successive paint of two curved surfaces (27, 27') of each said part, each said part is moved between different paint positions (34, 34') by changing a position of an element (17) of the conveying system (12) supporting the corresponding holding means (25).

4. The method in accordance with claim 1, wherein the surface (27) of the parts to be painted are provided with both a poured on clear paint and a previously poured base paint.

5. A device for painting body parts of motor vehicles, wherein at least one surface of each part of the body parts to be painted is curved in a plane parallel to a conveying direction of a conveying system for the body parts, said device comprising a paint curtain device for painting the body parts having a pouring head (1) for creating a falling paint curtain (5) consisting of liquid paint flowing downward, a collecting device (6) for used paint from the paint curtain (5), disposed at a distance below the pouring head (1), the conveying system (12) arranged outside of the area acted upon by the falling paint curtain for conveying the parts (13) to be painted on a conveying path (15) crossing the falling paint curtain (5) transversely in respect to a plane of the falling paint curtain, wherein holding means (25) are provided on the conveying system (12) which permit releasable fixing of parts (13) to be painted so that the curved surface (27) faces toward the pouring head, the parts (13) to be painted remaining on the holding means (25) when passing through the paint curtain (5), wherein the conveying system (12) is located laterally of a pouring zone (8) of the falling paint curtain (5) during operation and wherein the holding means (25) are directed from a side of the conveying oath (15) crossing the plane of the falling paint curtain (14), so that the holding means pass through the falling paint curtain (5) when moving through one of two lateral side edges (16) of the falling paint curtain, and wherein control means (43) for changing a position of the holding means (25) or at least one section of the holding means are provided to change a position of the parts (13) adjustable fixed in place on the corresponding holding means during passage through the falling paint curtain (5).

6. The device in accordance with claim 5, wherein the conveying system (12) has at least one circulating conveyor belt (17) which is embodied as a link belt (23), and on which a plurality of holding means (25) are disposed at distances from each other.

7. The device in accordance with claim 5, wherein the falling paint curtain (5) is continuously maintained between individual painting operations.

8. The device in accordance with claim 5, wherein the holding means (25) are embodied as holding arms which have a rod structure.

9. The device in accordance with claim 5 wherein fastening means (26) for the parts (13) to be painted provided on the holding means (25), and are embodied as magnetic elements.

10. The device in accordance with claim 5 wherein fastening means (26) for the parts (13) to be painted are provided on the holding means (25), and are embodied as clamping elements.

11. The device in accordance with claim 5, wherein the control means (43) for changing a position of the holding means is provided to give the each said part (13) to be painted fastened to the holding means a different position during at least two successive paint pouring steps as each said part passes through more than one said falling paint curtain (5) arranged next to each other.

12. The device in accordance with claim 5, wherein the control means (32, 43) act on an element of the conveying system (12) supporting the holding means (25).

13. The device in accordance with claim 5, wherein the control means (32, 43) act on a movable section (36) of the holding means (25).

14. The device in accordance with claim 5, wherein lateral edge limiters (38, 39) for the falling paint curtain (5) are provided which, starting at the pouring head (1), extend downward, wherein the holding means (25) are disposed in such a way that they extend underneath one associated edge limiter (38) of said lateral edge limiters, which terminates at a distance above the collecting device (6), when the holding means pass through the pouring zone (8) and hold the part (13) fixed on the holding means in such a way that the part extends with a surface (27) of the part being painted into an area of the falling paint curtain (5) which is flanked on both sides by edge limiters 38, 39).

15. A device for painting body parts of motor vehicles, wherein at least one surface of each part of the body parts to be painted is curved in in a plane parallel to a conveying direction of a conveying system for the body parts, said device comprising a paint curtain device for painting the body parts having a pouring head (1) for creating a falling paint curtain (5) consisting of liquid paint flowing downward, a collecting device (6) for used paint from the paint curtain (5), disposed at a distance below the pouring head (1), the conveying system (12) arranged outside of the area acted upon by the falling paint curtain for conveying the parts (13) to be painted on a conveying path (15) crossing the falling paint curtain (5) transversely in respect to a plane of the falling paint curtain, wherein holding means (25) are provided on the conveying system (12) which permit releasable fixing of parts (13) to be painted so that the curved surface (27) faces toward the pouring head, the parts (13) to be painted [remain] remaining on the holding means (25) when passing through the paint curtain (5), wherein the conveying system (12) is located laterally of a pouring zone (8) of the falling paint curtain (5) during operation and wherein the holding means (25) are directed from a side of the conveying path (15) crossing the plane of the falling paint curtain (14), so that the holding means pass through the falling paint curtain (5) when moving through one of two lateral side edges (16) of the falling paint curtain, and wherein control means (43) for changing a position of the holding means (25) or at least one section of the holding means are provided to change a position of the parts (13) adjustable fixed in place on the corresponding holding means during passage through the falling paint curtain (5), the holding means has at least one holding arm, said holding arm holding each said part into the falling paint curtain from a lateral side edge of said two lateral side edges of the falling paint curtain.

* * * * *